US008284137B2

(12) United States Patent
Yoo

(10) Patent No.: US 8,284,137 B2
(45) Date of Patent: Oct. 9, 2012

(54) APPARATUS AND METHOD OF DRIVING BACKLIGHT OF LIQUID CRYSTAL DISPLAY

(75) Inventor: Yeon-Taek Yoo, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 853 days.

(21) Appl. No.: 11/646,487

(22) Filed: Dec. 28, 2006

(65) Prior Publication Data

US 2007/0296686 A1 Dec. 27, 2007

(30) Foreign Application Priority Data

Jun. 23, 2006 (KR) ..... 10-2006-0057132
Dec. 1, 2006 (KR) ..... 10-2006-0120887

(51) Int. Cl.
*G09G 3/32* (2006.01)
*G09G 3/36* (2006.01)

(52) U.S. Cl. ..... 345/83; 345/102

(58) Field of Classification Search ..... 345/102, 345/67–82, 83
See application file for complete search history.

(56) References Cited

U.S. PATENT DOCUMENTS 6,867,757 B1 * 3/2005 Nakamura ..... 345/83
6,961,038 B2 * 11/2005 Yoshinaga et al. ..... 345/88
7,106,294 B2 * 9/2006 Kumamoto et al. ..... 345/102
2006/0055660 A1 * 3/2006 Teranishi ..... 345/102
2006/0119565 A1 * 6/2006 Matsumoto ..... 345/102
2006/0239689 A1 * 10/2006 Ashdown ..... 398/130
2006/0284894 A1 12/2006 Johnson et al.
2007/0024210 A1 * 2/2007 Zwanenburg et al. ..... 315/291

FOREIGN PATENT DOCUMENTS

| | | |
|---|---|---|
| JP | 2000-214825 | 8/2000 |
| JP | 2002-351405 | 12/2002 |
| JP | 2005-266751 | 9/2005 |
| JP | 2006-164631 | 6/2006 |
| JP | 2007-503610 | 2/2007 |
| WO | WO 03/075617 | 9/2003 |

* cited by examiner

*Primary Examiner* — Amr Awad
*Assistant Examiner* — Stephen Bray
(74) *Attorney, Agent, or Firm* — LG Display Co., Ltd.

(57) ABSTRACT

An apparatus for driving a backlight includes: a pulse width modulation signal phase shifting unit that shifts phases of at least one of red, green, and blue pulse width signal modulation signals so as to output at least one of phase-shifted red, green, and blue pulse width signal modulation signals; red, green, and blue light emitting diode arrays, each of which includes a plurality of light emitting diodes; and at least one light emitting diode driving unit driving one of the red, green, and blue light emitting diode arrays by using one of the phase-shifted red, green, and blue pulse width signal modulation signals.

4 Claims, 8 Drawing Sheets

APPARATUS AND METHOD OF DRIVING BACKLIGHT OF LIQUID CRYSTAL DISPLAY

The present application claims the benefit of Korean Patent Application No. 2006-0057132 filed in Korea on Jun. 23, 2006 and Korean Patent Application No. 2006-00120887 filed in Korea on Dec. 1, 2006, which are both hereby incorporated by reference in their entirety.

BACKGROUND OF THE INVENTION

1. Field of the Invention

Embodiments of the invention relate to a display device, and more particularly, to an apparatus and a method of driving a backlight of a liquid crystal display. Although embodiments of the invention are suitable for a wide scope of applications, they are particularly suitable for minimizing wave noise on a liquid crystal panel generated by a backlight that uses light emitting diodes (LEDs) as a light source.

2. Description of the Related Art

In general, the application of liquid crystal displays (hereinafter, simply referred to as "LCDs") has extended into office automation equipment, audio/video devices and the like due to characteristics, such as light weight, small size, and low power consumption. The LCDs are devices that display desired images by controlling transmittance of light generated from a backlight according to image signals that are applied to a plurality of control switches arranged in a matrix shape.

LCDs are not self-luminous displays, and thus each of the LCDs includes a light source, such as a backlight, that is disposed at the rear of the LCD. In general, fluorescent lamps are used as the backlight of the LCD. Light sources for an LCD are divided into a direct type LCD and a side type LCD according to the position of the backlight. Light emitting diodes (LEDs) have been widely used as backlights of small LCDs in personal digital assistants (PDAs), cellular phones, notebook computers and the like.

FIGS. 1(*a*) and 1(*b*) are perspective views illustrating a structure of a side type backlight and a structure of a direct type backlight, respectively. More specifically, FIG. 1(*a*) is a view illustrating a structure of a side type backlight in which sets of light emitting diode arrays 12 are formed at sides of a diffuse film lining cavity 11. Further, FIG. 1(*b*) is a view illustrating a structure of a direct type backlight in which the sets of light emitting diode arrays 12 are formed at a rear surface of the diffuse film lining cavity 11.

FIGS. 2 and 3 illustrate arrangements of light emitting diodes that are used as the backlight in the liquid crystal display according to the related art. FIGS. 2(*a*) and 2(*b*) are schematic views each illustrating a backlight that is implemented with a few high-power light emitting diodes. FIG. 3 is a schematic view illustrating a backlight that is implemented with normal light emitting diodes. FIG. 4 is a block diagram of a driving circuit of a backlight according to the related art.

As shown in FIG. 4, an apparatus for driving a backlight includes red, green and blue light emitting diode driving units 41R, 41G, and 41B that drive red, green and blue light emitting diode arrays 42R, 42G, and 42B, respectively. More specifically, the red, green and blue light emitting diode arrays 42R, 42G, and 42B are lit by pulse width modulation signals supplied from the red, green and blue light emitting diode driving units 41R, 41G, and 41B, respectively, so as to emit red, green, and blue light. The operation of the apparatus for driving a backlight that has the above-described structure will be described with reference to FIGS. 5(*a*), 5(*b*) and 5(*c*).

FIGS. 5(*a*), 5(*b*), and 5(*c*) are waveforms of pulse width modulation signals for red, green, and blue, respectively. The red, green and blue light emitting diode driving units 41R, 41G, and 41B respectively drive in a burst mode, red, green and blue light emitting diode arrays 42R, 42G, and 42B in which light emitting diodes LED_R, green light emitting diodes LED_G, and blue light emitting diodes LED_B are connected in series in their respective array. Further, the red, green and blue light emitting diode driving units 41R, 41G, and 41B perform dimming control in the burst mode with a pulse width modulation signal PWM_R, PWM_G, and PWM_B for red, green, and blue lights, as shown in FIGS. 5(*a*), 5(*b*), and 5(*c*).

When the red, green, and blue light emitting diode driving units 41R, 41G, and 41B output the pulse width modulation signals PWM_R, PWM_G, and PWM_B to the red, green, and blue light emitting diode arrays 42R, 42G, and 42B, the pulse width modulation signal PWM_R, PWM_G, and PWM_B for red, green, and blue are synchronized and output, as shown in FIGS. 5(*a*), 5(*b*), and 5(*c*). Therefore, the red light emitting diodes LED_R, the green light emitting diodes LED_G, and the blue light emitting diodes LED_B are lit by the pulse width modulation signal PWM_R, PWM_G, and PWM_B that are respectively supplied from the red, green, and blue light emitting diode driving units 41R, 41G, and 41B, such that red, green, and blue light components are transmitted. The red, green, and blue light components mix to produce white light, which is supplied toward the rear surface of the liquid crystal panel.

As shown in FIGS. 5(*a*), 5(*b*) and 5(*c*), the pulse width modulation signals PWM_R, PWM_G, and PWM_B have periods where the signals overlap each other. When the three pulse width modulation signals PWM_R, PWM_G, and PWM_B for red, green, and blue light overlap each other, frequencies generated from the red, green, and blue light emitting diode driving units 41R, 41G, and 41B affect data lines of the liquid crystal panel, which causes distortion in the charging time of the data lines. Wave noise is generated in the liquid crystal panel due to distortion in the charging time of the data lines. To prevent the wave noise from occurring in the liquid crystal panel, a method that changes PWM dimming frequencies of the red, green, and blue light emitting diode driving units 41R, 41G, and 41B has been used. However, this method of removing the wave noise is fundamentally difficult to implement. Further, since frequency margins are small, it is difficult to efficiently prevent the generation of the wave noise.

SUMMARY OF THE INVENTION

Accordingly, embodiments of the invention is directed to an apparatus and method of driving a backlight of a liquid crystal display that substantially obviates one or more of the problems due to limitations and disadvantages of the related art.

An object of embodiments of the invention is to provide an apparatus and method of driving a backlight that removes wave noise from the backlight of a liquid crystal display that uses light emitting diodes as a light source.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described herein, there is provided an apparatus for driving a backlight that includes: a pulse width modulation signal phase shifting unit that shifts phases of at least one of red, green, and blue pulse width signal modulation signals so as to output at least one of phase-shifted red, green, and blue pulse width signal modulation signals; red, green, and blue light emitting diode arrays, each of which includes a plurality of light emitting diodes; and at least one light emitting diode driving unit driving one of the red, green, and blue light emitting diode arrays by using one of the phase-shifted red, green, and blue pulse width signal modulation signals.

In another aspect, a method of driving a backlight includes: shifting phases of at least one of red, green, and blue pulse width signal modulation signals so as to minimize overlap among the phase-shifted red, green, and blue pulse width signal modulation signals; and driving red, green, and blue light emitting diode arrays respectively using the at least one of phase-shifted red, green, and blue pulse width signal modulation signals.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 6:
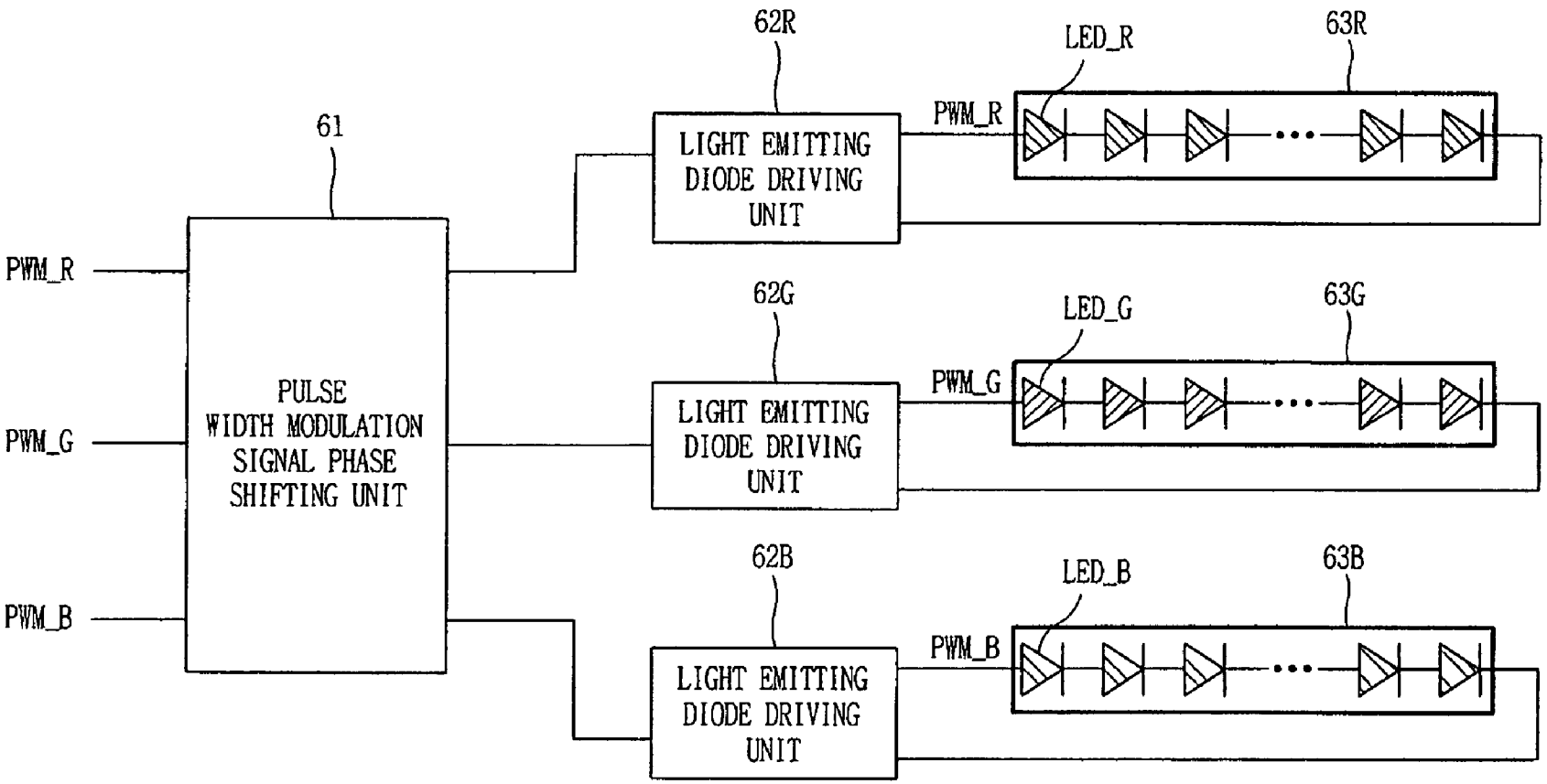
FIG. 6 is a block diagram of an apparatus for driving a backlight of a liquid crystal display according to an embodiment of the invention.

FIG. 6 is a block diagram of an apparatus for driving a backlight of a liquid crystal display according to an embodiment of the invention. As shown in FIG. 6, an apparatus for driving a backlight according to an embodiment of the invention includes a pulse width modulation signal phase shifting unit 61 that appropriately shifts phases of red, green, and blue pulse width modulation signals PWM_R, PWM_G, and PWM_B according to the type of a backlight so as to output the phase-shifted pulse width modulation signals, red, green, and blue light emitting diode driving units 62R, 62G, and 62B that drive the red, green, and blue light emitting diode arrays 63R, 63G, and 63B, respectively, by using the phase-shifted red, green, and blue pulse width modulation signals PWM_R, PWM_G, and PWM_B, and the red, green, and blue light emitting diode arrays 63R, 63G, and 63B that are lit by the red, green, and blue pulse width modulation signals PWM_R, PWM_G, and PWM_B, respectively, which are respectively supplied from the light emitting diode driving units 62R, 62G, and 62B, so as to emit red, green, and blue light. Hereinafter, the apparatus for driving a backlight that has the above-described structure will be described in detail with reference to FIGS. 7 to 9.

Figure 7:
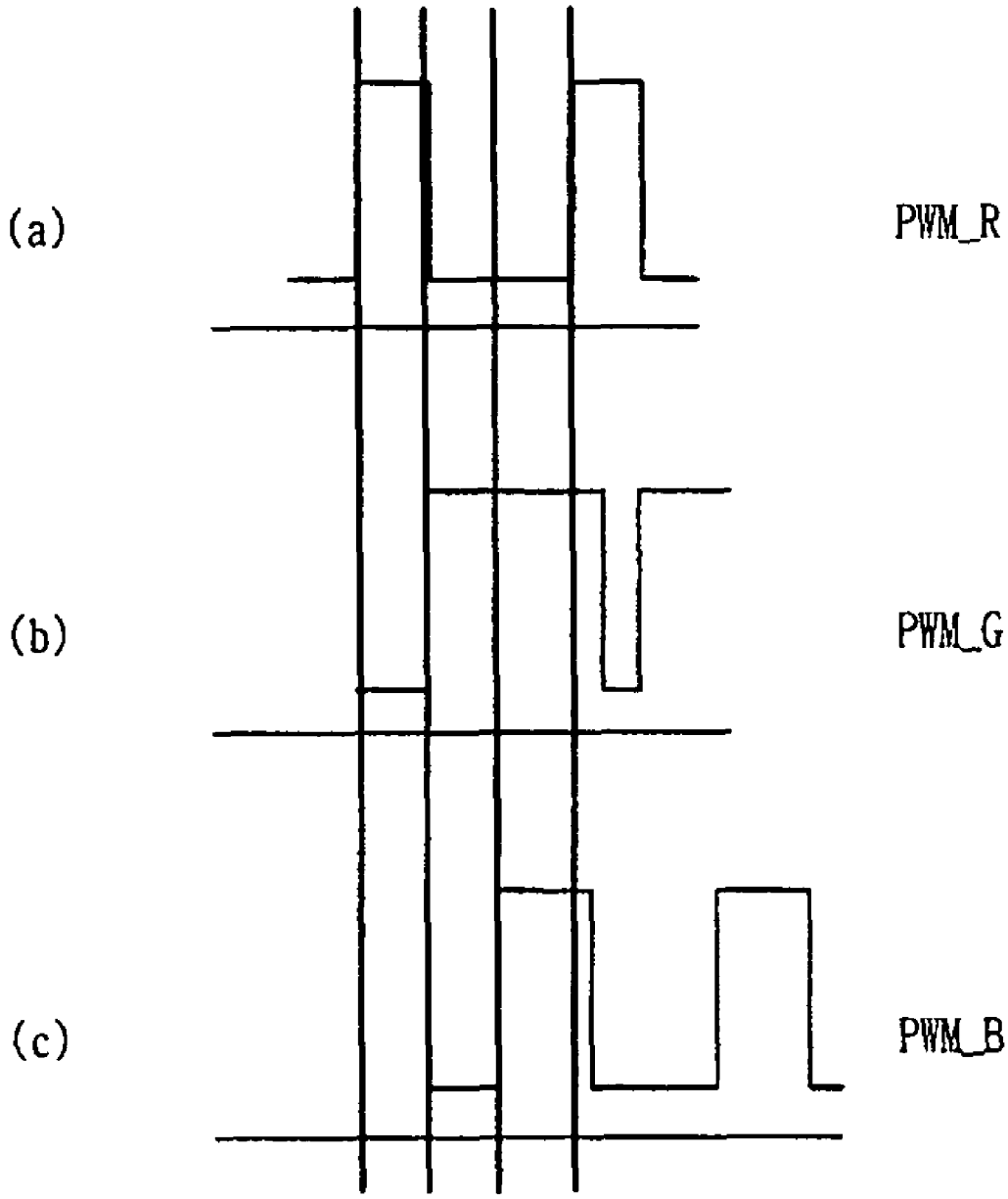
FIGS. 7(*a*) to 7(*c*) are waveforms of red, green, and blue pulse width modulation signals that have been phase-shifted amongst each other.

FIGS. 7(*a*) to 7(*c*) are waveforms of red, green, and blue pulse width modulation signals that have been phase-shifted amongst each other. The pulse width modulation signal phase shifting unit 61 appropriately shifts the phases of the red, green, and blue pulse width modulation signals PWM_R, PWM_G, and PWM_B which are supplied from the outside, according to the type of the backlight so as to output red, green, and blue phase-shifted pulse width modulation signals. That is, the pulse width modulation signal phase shifting unit 61 shifts the phases of the red, green, and blue pulse width modulation signals PWM_R, PWM_G, and PWM_B by calculated values according to whether backlight is the side type or the direct type so as to output red, green, and blue phase-shifted pulse width modulation signals PWM_R, PWM_G, and PWM_B to the red, green, and blue light emitting diode driving units 62R, 62G, and 62B.

There may be various methods by which the pulse width modulation signal phase shifting unit 61 shifts the phases of the red, green, and blue pulse width modulation signals PWM_R, PWM_G, and PWM_B. For example, when the backlight is the side type using light emitting diodes, the phases of the red, green, and blue pulse width modulation signals PWM_R, PWM_G, and PWM_B are sequentially shifted by a predetermined angle, and the phase-shifted red, green, and blue pulse width modulation signals are output, as shown in FIG. 7.

Figure 1A:
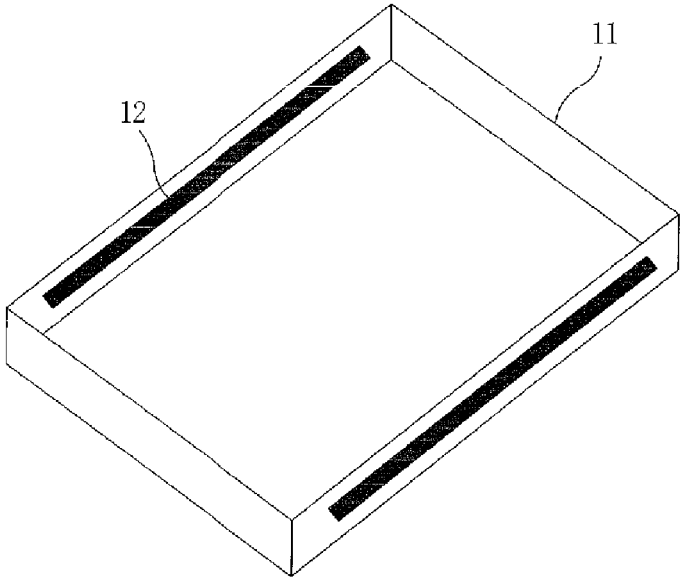
FIG. 1A RELATED ART
FIGS. 1(*a*) and 1(*b*) are perspective views respectively illustrating a structure of a side type backlight and a structure of a direct type backlight according to the related art.

When the backlight type is the direct type, as shown in FIG. 1*a*, the angle by which each of the phases of the red, green, and blue pulse width modulation signals PWM_R, PWM_G, and PWM_B shifted is set by a calculation based on minimizing overlapping portions among the red, green, and blue pulse width modulation signals PWM_R, PWM_G, and PWM_B. For example, as shown in FIG. 7, the pulse width modulation signal PWM_R for red is output like the related art, the pulse width modulation signal PWM_G for green is delayed by about 120° and then output, and the pulse width modulation signal PWM_B for blue is delayed by about 240° and then output. The calculation is performed on the basis of waveforms of the red, green, and blue pulse width modulation signals PWM_R, PWM_G, and PWM_B applied to the light emitting diodes used for the side type backlight according to the related art, such that the overlapping portions among the red, green, and blue pulse width modulation signals PWM_R, PWM_G, and PWM_B in a set of red, green, and blue light emitting diode arrays can be minimized.

Figure 1B:
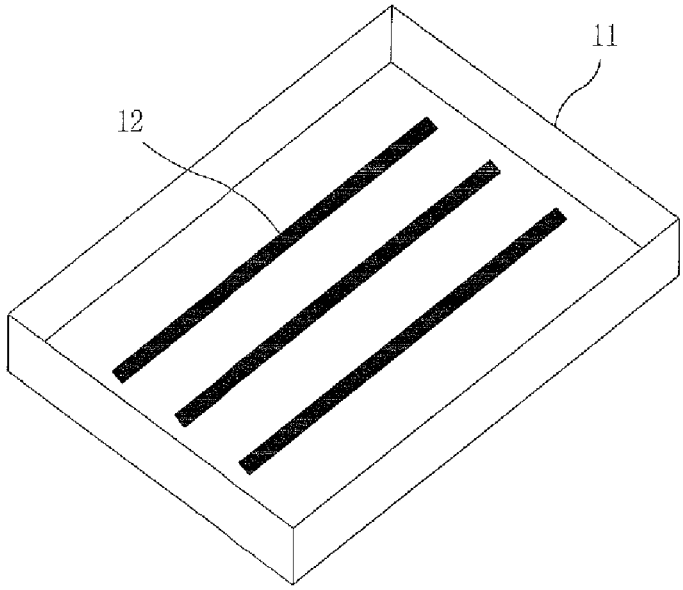
FIG. 1B RELATED ART
Figure 2:
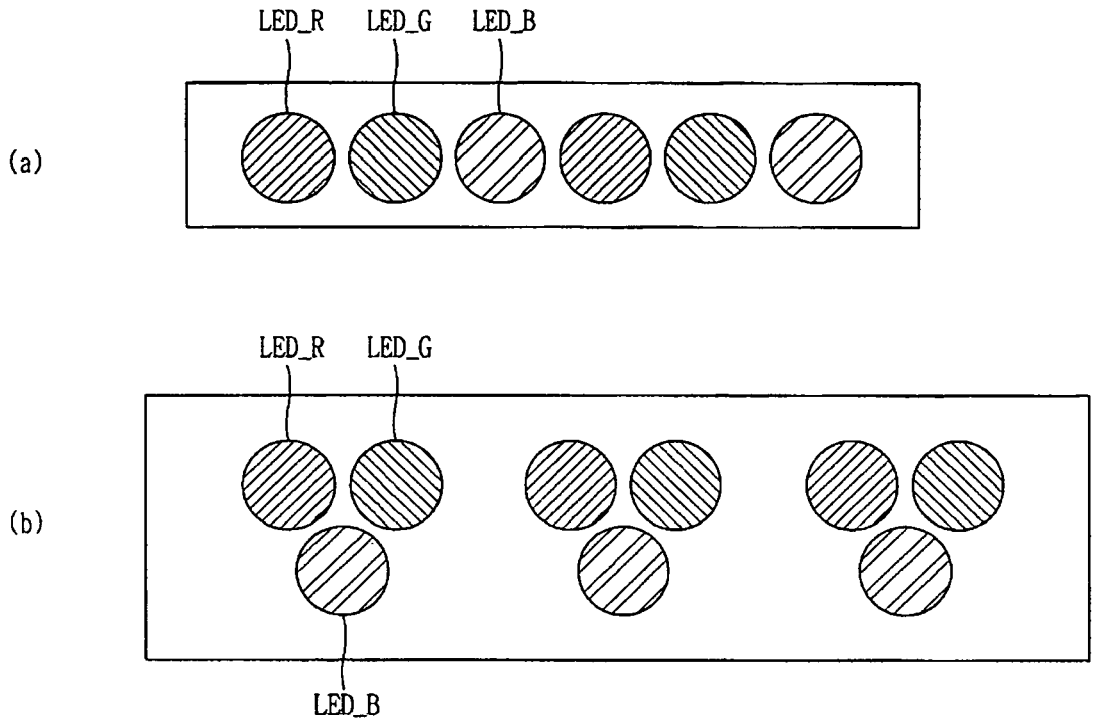
FIG. 2 RELATED ART
FIGS. 2(*a*) and 2(*b*) are schematic views each illustrating a backlight that is implemented with a few high-power light emitting diodes according to the related art.
Figure 3:
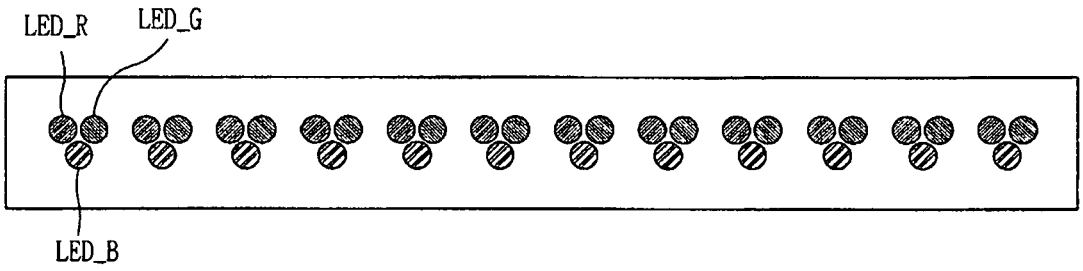
FIG. 3 RELATED ART
FIG. 3 is a schematic view illustrating a backlight that is implemented with normal light emitting diodes according to the related art.
Figure 4:
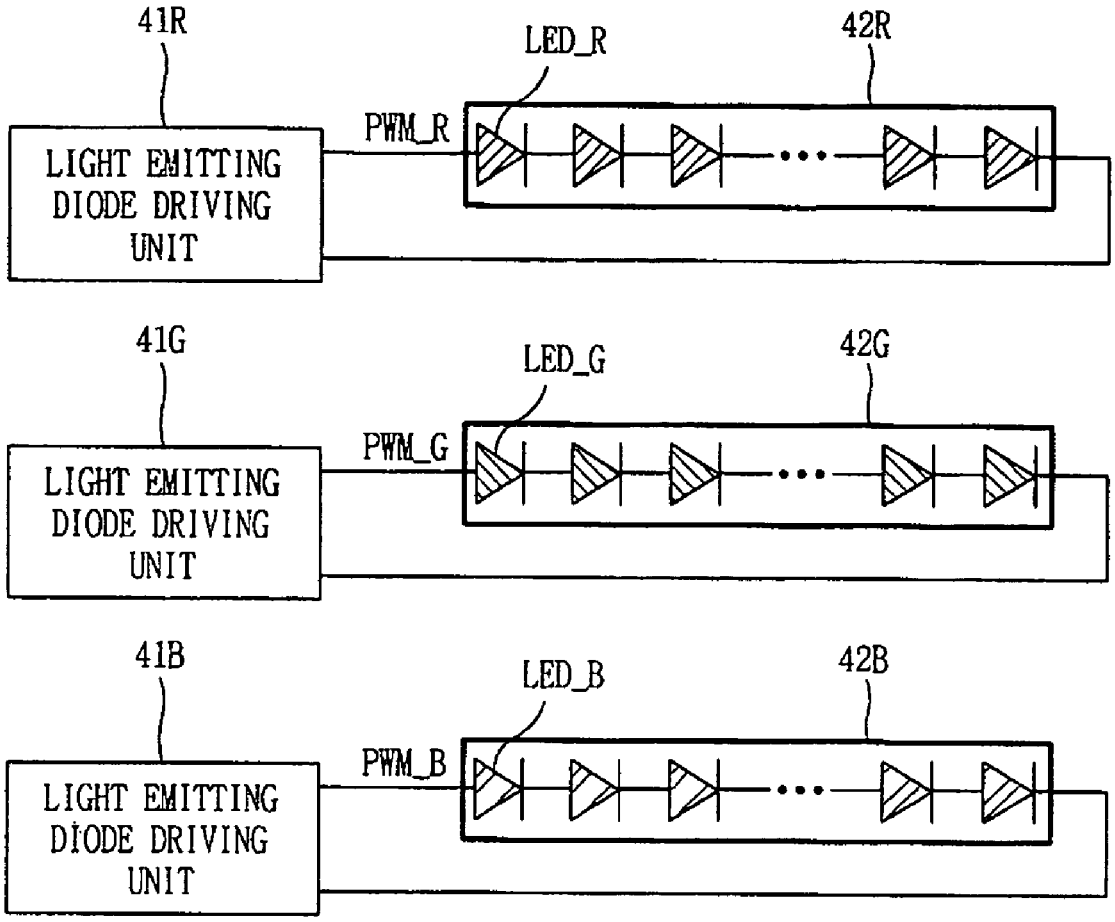
FIG. 4 RELATED ART
FIG. 4 is a block diagram of a backlight driving circuit according to the related art.
Figure 5:
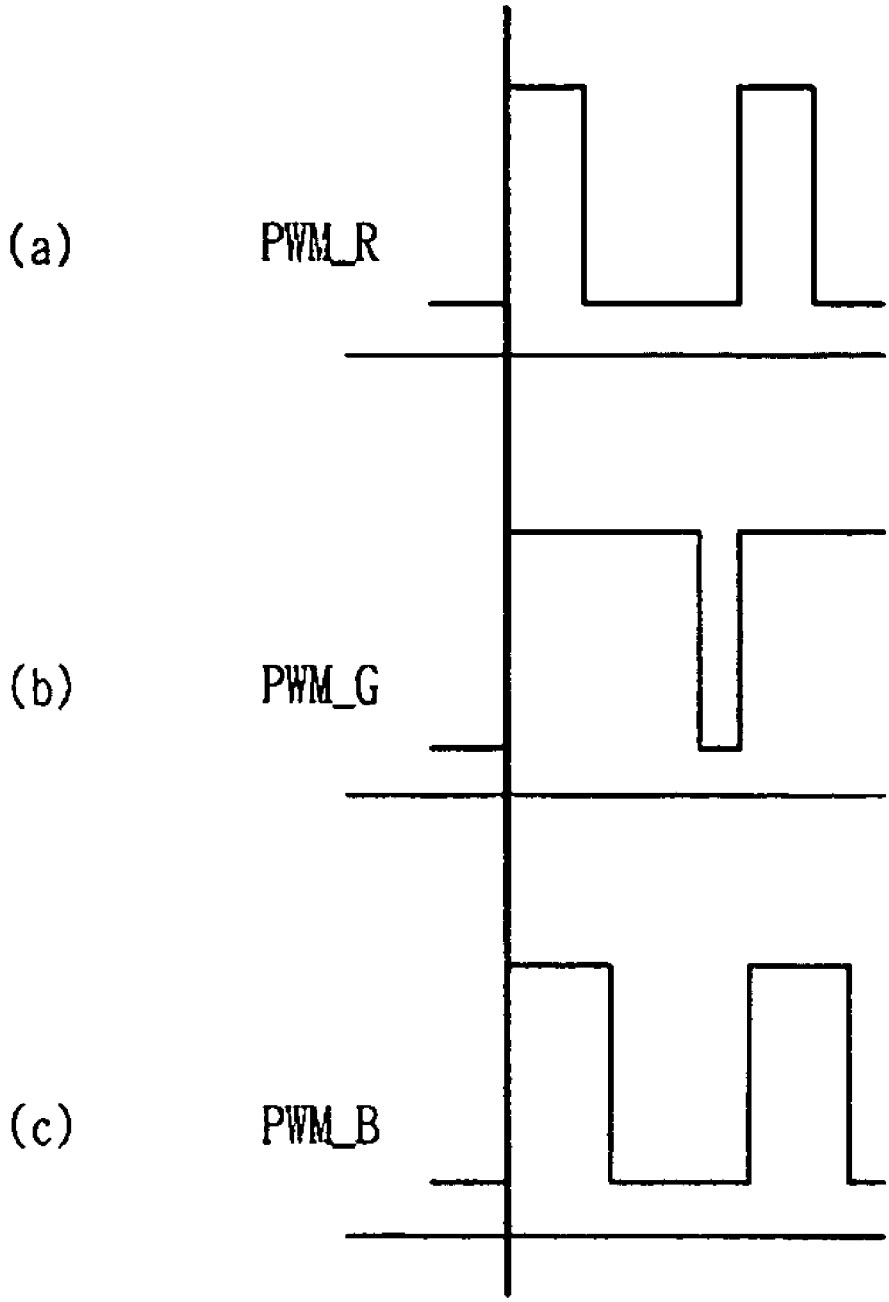
FIG. 5 RELATED ART
FIGS. 5(*a*), 5(*b*), and 5(*c*) are waveforms of pulse width modulation signals for red, green, and blue, respectively according to the related art.
Figure 8:
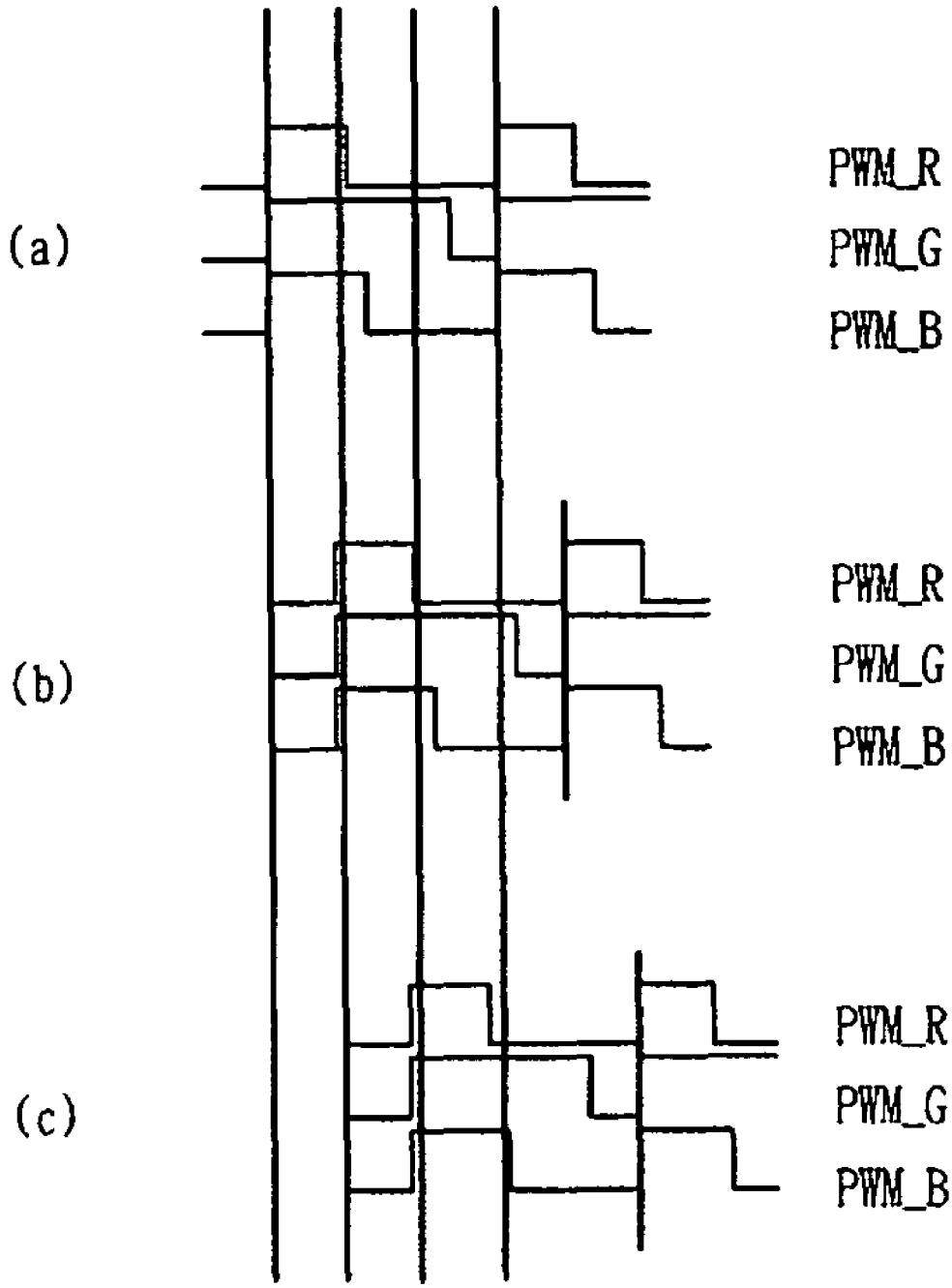
FIGS. 8(*a*) to 8(*c*) are waveforms of pulse width modulation signals for red, green, and blue that are phase-shifted for each set of light emitting diode arrays having red, green and blue diodes amongst a plurality of sets of light emitting diode arrays.

FIGS. 8(*a*) to 8(*c*) are waveforms of pulse width modulation signals for red, green, and blue that are phase-shifted for each set of light emitting diode arrays having red, green and blue diodes amongst a plurality of sets of light emitting diode arrays. When the backlight type is the direct type, as shown in FIG. 1*b*, phases of the pulse width modulation signals of each set of the red, green, and blue light emitting diode arrays are sequentially shifted by a predetermined angle, and the phase-shifted pulse width modulation signals for each set of the light emitting diode arrays are output, as shown in FIG. 8. The angle by which the phases are shifted is determined by a calculation on the basis of the number of sets of red, green, and blue light emitting diode arrays so as to minimize the overlapping frequencies each set of the light emitting diode arrays. For example, if there are three or a multiple of three sets of red, green, and blue light emitting diode arrays, the phases of the pulse width modulation signals of each set of the red, green, and blue light emitting diode arrays is shifted by about 120°. As shown in FIG. 8, frequency overlapping among the red, green, and blue pulse width modulation signals PWM_R, PWM_G, and PWM_B between sets of red, green, and blue light emitting diode arrays is minimized.

Figure 9:
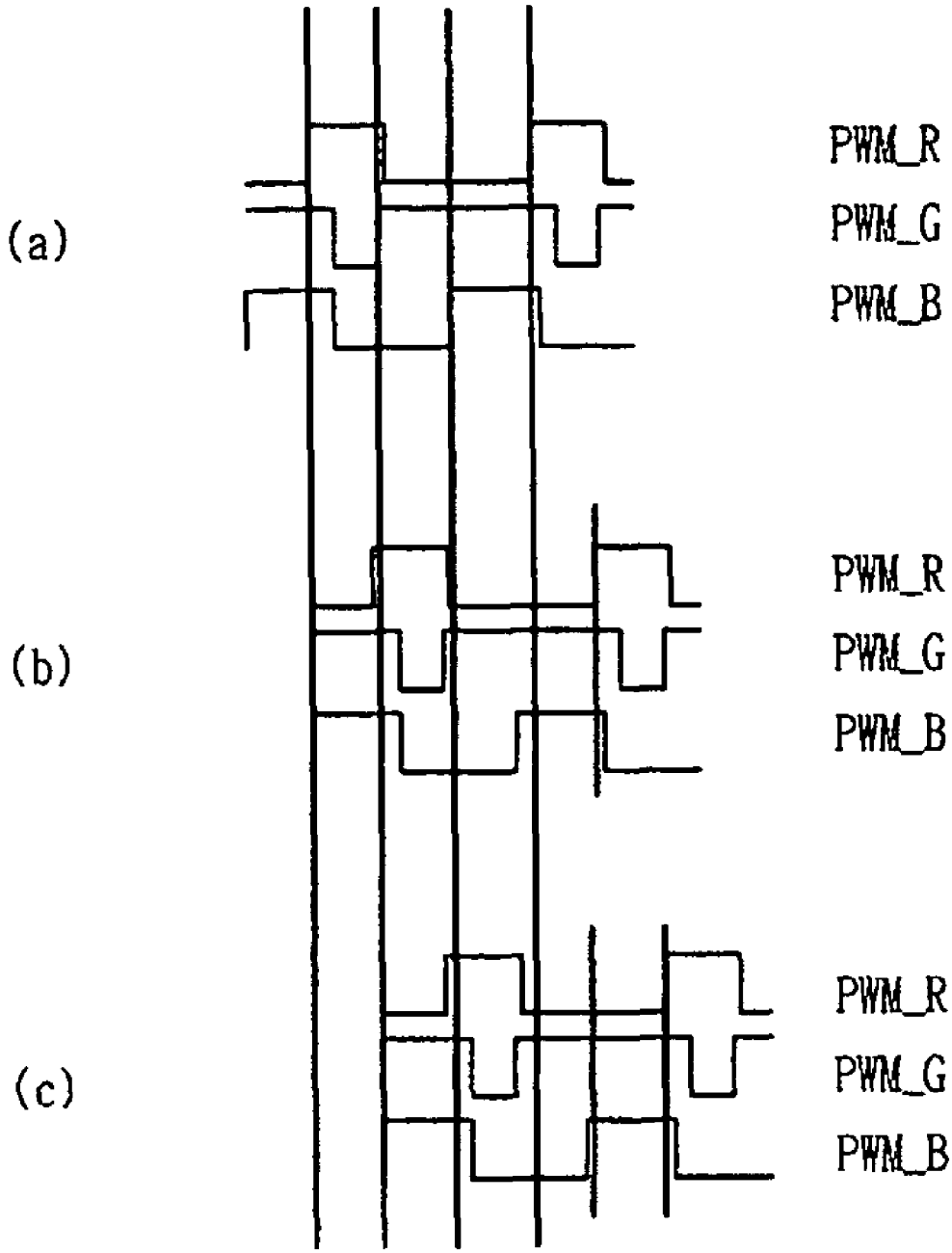
FIGS. 9(*a*) to 9(*c*) are waveforms of red, green, and blue pulse width modulation signals that have been phase-shifted amongst each other and are phase-shifted for each set of light emitting diode array having red, green and blue diodes amongst a plurality of sets of light emitting diode arrays.

FIGS. 9(*a*) to 9(*c*) are waveforms of red, green, and blue pulse width modulation signals that have been phase-shifted amongst each other and are phase-shifted for each set of light emitting diode array having red, green and blue diodes amongst a plurality of sets of light emitting diode arrays. According to another embodiment of the invention, as shown in FIG. 9, the phases of the pulse width modulation signals amongst sets of red, green, and blue light emitting diode arrays are sequentially shifted by a predetermined angle, and at the same time, the phases of the respective red, green, and blue pulse width modulation signals PWM_R, PWM_G, and PWM_B amongst each other in a light emitting diode array are shifted by a predetermined angle, and then the resequenced phase-shifted pulse width modulation signals are output. For example, the phases of the pulse width modulation signals of three sets of red, green, and blue light emitting diode arrays are resequenced by a shift of about 120°, and at the same time, the phase of each of the red, green, and blue pulse width modulation signals PWM_R, PWM_G, and PWM_B for red, green, and blue is shifted by about 120°, and then the resequenced phase-shifted pulse width modulation signals are output. The angle by which the phases are shifted is determined by a calculation on the basis of the number of sets of red, green, and blue light emitting diode arrays and the frequency of the pulse width modulation signals PWM_R, PWM_G, and PWM_B so as to minimize the overlapping among the frequencies in each set of red, green, and blue light emitting diode arrays and among the sets of red, green, and blue light emitting diode arrays. As shown in FIG. 9, frequency overlap among the sets of red, green, and blue light emitting diode arrays and overlapping portion among the red, green, and blue pulse width modulation signals PWM_R, PWM_G, and PWM_B in each set of red, green, and blue light emitting diode arrays are minimized. Therefore, the effect of the frequencies generated from the red, green, and blue light emitting diode driving units 62R, 62G, and 62B on the data lines of the liquid crystal panel is minimized, and the distortion of the charging time of the data lines is minimized. Accordingly, the wave noise on the liquid crystal panel that occurs when the light emitting diodes are used in the backlight is minimized.

Although not shown in the drawings, when the backlight is implemented by using the high power light emitting diodes, the phases of the pulse width modulation signals PWM_R, PWM_G, and PWM_B for red, green and blue are sequentially shifted by a predetermined angle amongst themselves like the above-described embodiment. Further, when the backlight is implemented by arranging the normal light emitting diodes in the array form, the phases of the pulse width modulation signals of each set of the red, green and blue light emitting diode arrays 63R, 63G, and 63B are sequentially shifted by a predetermined angle amongst themselves and the resequenced pulse width modulation signals are output. The red, green, and blue light emitting diode driving units 62R, 62G, and 62B are driven in the burst mode, the red, green, and blue light emitting diode arrays 63R, 63G, and 63B, in which the red light emitting diodes LED_R, the green light emitting diodes LED_G, and the blue light emitting diodes LED_B, are respectively connected in series to each other, by using the red, green, and blue pulse width modulation signals PWM_R, PWM_G, and PWM_B for red, green, and blue, whose phases are shifted.

As described above, according to the backlight type, the phases of the red, green, and blue pulse width modulation signals PWM_R, PWM_G, and PWM_B are shifted amongst themselves, or amongst themselves and sets of light emitting diode arrays such that the wave noise is efficiently removed. As a result, the frequency margin of the pulse width modulation signals available is increased as compared to the related art. That is, when compared to the method according to the related art that only changes the PWM dimming frequencies so as to minimize the wave noise, the frequency margin is increased according to the embodiments of the inventions because a range in which the frequencies can be changed amongst the pulse width modulation signals, or amongst the pulse width modulation signals and the light emitting diode arrays is wide. Further, while the method according to the embodiments of the invention is applied, the method according to the related art of changing the PWM dimming frequencies may also be applied. In this case, the margin of the PWM dimming frequency is also increased two times more than the related art (e.g. ±10 Hz→±20 Hz).

As described above in detail, according to the embodiments of the invention, the wave noise can be efficiently removed by shifting the phases of the pulse width modulation amongst the pulse width modulation signals and/or amongst the light emitting diode arrays according to the backlight types so to output phase-shifted pulse width modulation signals or resequenced phase-shifted pulse width modulation signals in the backlight that uses light emitting diodes as the light source in the liquid crystal display. In addition, since the wave noise can be efficiently removed, it is possible to increase the frequency margin of the pulse width modulation signals to twofold more than the related art.

It will be apparent to those skilled in the art that various modifications and variations can be made in the apparatus and method of driving a backlight of a liquid crystal display of embodiments of the invention without departing from the spirit or scope of the invention. Thus, it is intended that embodiments of the invention cover the modifications and variations of this invention provided they come within the scope of the appended claims and their equivalents.

What is claimed is:

1. An apparatus for driving a backlight of the direct type comprising:

a pulse width modulation signal phase shifting unit that shifts phases of red, green, and blue pulse width modulation signals and outputs the phase-shifted pulse width modulation signals by a predetermined angle such that an overlapping region among red, green and blue pulse width modulation signals is minimized;

red, green, and blue light emitting diode driving units that drive red, green, and blue light emitting diode arrays by using the phase-shifted red, green, and blue pulse width modulation signals; and red, green, and blue light emitting diode arrays that are lit by the red, green, and blue pulse width modulation signals, which are supplied from the light emitting diode driving units so as to emit red, green, and blue light, wherein the pulse width modulation signal phase shifting unit is configured to sequentially shift the phases of the pulse width modulation signals amongst sets of red, green, and blue light emitting diode arrays by a predetermined angle, and at the same time, to shift the phases of the respective red, green, and blue pulse width modulation signals amongst each other in a light emitting diode array by the predetermined angle, and then to output the resequenced phase-shifted pulse width modulation signals, and wherein a width of the green phase-shifted pulse width modulation signal is wider than widths of the red and blue phase-shifted pulse width modulation signals.

2. The apparatus of claim 1, wherein rising edges of the red green and blue phase-shifted pulse width modulation signals start at a different time.

3. A method of driving a backlight of the direct type, comprising:

shifting phases of red, green, and blue pulse width modulation signals and outputs the phase-shifted pulse width modulation signals by a predetermined angle such that an overlapping region among red, green and blue pulse width modulation signals is minimized; and driving red, green, and blue light emitting diode arrays respectively using the at least one of phase-shifted red, green, and blue pulse width signal modulation signals, wherein the step of shifting phases comprises sequentially shifting the phases of the pulse width modulation signals amongst sets of red, green, and blue light emitting diode arrays by a predetermined angle, and at the same time, shifting the phases of the respective red, green, and blue pulse width modulation signals amongst each other in a light emitting diode array by the predetermined angle, and then outputting the resequenced phase-shifted pulse width modulation signals, and wherein a width of the green phase-shifted pulse width modulation signal is wider than widths of the red and blue phase-shifted pulse width modulation signals.

4. The method of claim 3, wherein rising edges of the red green and blue phase-shifted pulse width modulation signals start at a different time.

* * * * *